US005370193A

United States Patent [19]

Sippus et al.

[11] Patent Number: 5,370,193

[45] Date of Patent: Dec. 6, 1994

[54] HYDRAULIC IMPACT HAMMER

[75] Inventors: Timmo Sippus; Seppo Jurvanen, Lahti, both of Finland

[73] Assignee: Bretec OY, Lahti, Finland

[21] Appl. No.: 186,307

[22] Filed: Jan. 25, 1994

Related U.S. Application Data

[60] Division of Ser. No. 77,555, Jun. 14, 1993, Pat. No. 5,325,929, which is a continuation-in-part of Ser. No. 910,705, Jul. 8, 1992, abandoned.

[30] Foreign Application Priority Data

Jul. 9, 1991 [FI] Finland ..... 913311

[51] Int. Cl.[5] ..... B25D 17/24

[52] U.S. Cl. ..... 173/211; 173/162.1

[58] Field of Search ..... 173/162.1, 162.2, 210, 173/211, 128

[56] References Cited

U.S. PATENT DOCUMENTS

| | | | |
|---|---|---|---|
| 1,774,905 | 9/1930 | Smrdel . | |
| 2,024,684 | 12/1935 | Erfass . | |
| 3,168,324 | 2/1965 | Kennell | 173/210 |
| 3,511,127 | 5/1970 | Smith . | |
| 4,592,431 | 6/1986 | Tornqvist | 173/162.1 |
| 4,681,172 | 7/1987 | Mikiya et al. | 173/210 |
| 4,723,610 | 2/1988 | Dummermuth et al. | 173/162.1 |
| 4,776,408 | 10/1988 | Elkin et al. | 173/162.1 |
| 5,082,067 | 1/1992 | Tornquist | 173/162.1 |

FOREIGN PATENT DOCUMENTS

| | | |
|---|---|---|
| 7603586 | 6/1977 | Finland . |
| 805268 | 3/1951 | Germany . |
| 2648389 | 5/1977 | Germany . |
| 366239 | 4/1974 | Sweden . |
| 460349 | 10/1989 | Sweden . |
| 1361944 | 7/1974 | United Kingdom . |
| 1587611 | 4/1981 | United Kingdom . |

*Primary Examiner*—Scott A. Smith
*Attorney, Agent, or Firm*—Smith-Hill and Bedell

[57] ABSTRACT

A hydraulic impact hammer comprises a protective casing, a hydraulically operated piston and a member for guiding the piston, and an impact member and a member for guiding the impact member. The piston-guiding member and the member guiding the impact member are made separate with respect to each other in order to prevent propagation of the tension wave reflected from the impact member. However, the piston-guiding member and the member guiding the impact member are each connected to the protective housing through at least one attenuating element.

8 Claims, 3 Drawing Sheets

HYDRAULIC IMPACT HAMMER

CROSS REFERENCE TO RELATED APPLICATION

This application is filed as a divisional of Ser. No. 08/077,555, filed Jun. 14, 1993, now U.S. Pat. No. 5,325,919, which is a continuation-in-part of co-pending application No. 07/910,705 filed Jul. 8, 1992, now abandoned, the disclosure of which is hereby incorporated by reference herein.

BACKGROUND OF THE INVENTION

This invention relates to a hydraulic impact hammer, particularly to the frame structure of an impact hammer, where the housing guiding the piston of the impact hammer is separated from the housing surrounding the impact member, so that the tension wave reflected from the impact member is prevented from proceeding to other parts of the hammer.

Impact hammers are divided, on the basis of their operating power for instance, into two main groups, i.e. pneumatic impact hammers and hydraulic impact hammers. The power of a pneumatic impact hammer is substantially lower than that of a hydraulic impact hammer. Likewise, pneumatic impact hammers are normally hand held, whereas hydraulic impact hammers are generally used in connection with various machines. For example, a hydraulic impact hammer may be used in drilling tunnels through rock, in which case the hammer is mounted on a carriage for advancing the hammer as the rock is broken and removed. In both hydraulic impact hammers and pneumatic impact hammers, a tension wave is reflected to other parts of the device. The DE patent 805,268 suggests an arrangement for reducing the effect of this tension wave. In DE 805,268, the guide ring of the impact member is made of elastic material. Moreover, the collar supporting the impact member is made of attenuating material. A similar structure is described in DE 805,748.

In a known hydraulic impact hammer, the housing or frame elements of the impact hammer, including a control valve system and valve housings of hydraulic fluid, a piston and a member guiding the piston, various sealing rings and a member guiding the impact member, are permanently interconnected either with long binding screws or with several shorter bolts. This structure is mounted inside a casing by means of attenuating elements provided around the impact hammer. The joining of the housing elements to each other causes various heavy strains on the whole impact hammer. Thus, the masses to be attenuated are large, which applies heavy loads to the various housing elements, and particularly to the members that interconnect the housing elements, i.e. the above mentioned screws or bolts. In similar fashion, in operation the junction surfaces of the impact hammer are in sliding contact with each other and are subjected to wear. Moreover, the tension wave reflected from the impact member is transmitted to the housing structure, which causes extra strains to other housing elements, as well as vibration and noise. The use of binding screws as the members that interconnect the housing elements also causes distortion in the housing elements and the binding screws themselves may be distorted, e.g. bent. Such distortions make the maintenance of the impact hammer difficult, in particular because it leads to difficulty in dismantling and re-assembling the interconnected elements.

SUMMARY OF THE INVENTION

The object of the present invention is to provide a new housing structure of a hydraulic impact hammer, which is more secure in operation and simpler in structure, and wherein the member that guides the piston of the impact hammer is separate from the member that guides the impact member of the impact hammer, and where both these guide members are advantageously separately attenuated with respect to the impact hammer casing.

According to the invention, the member guiding the piston of the impact hammer and the member guiding the impact member are both separately suspended by means of at least one attenuating element, so that there is no direct metal-to-metal contact between these two guide members. A direct contact between the piston and the impact member is only created at the moment of striking, when the piston hits the impact member.

In the impact hammer of the invention, the attenuating elements allow the housing elements of the impact hammer to move within the protective casing both axially and radially, depending on the load. The attenuating elements guiding the impact member receive the forces caused by the drive mechanism of the impact member, i.e. the forces due to the tension waves reflected from the impact member and the forces created when the impact member strikes, through intermediation of the holding pins, the member guiding the impact member in a so-called empty stroke, when there is no material to be crushed under the impact hammer. The attenuating elements of the member guiding the piston receive for instance the forces created while accelerating the piston of the impact hammer.

In the impact hammer of the invention, the attenuating elements of both the member guiding the piston and the member guiding the impact member are advantageously installed so that the attenuating elements centralize these guidemembers with respect to each other when there is no external load. Under external load, the housing elements can be arranged radially with respect to each other, if necessary by means of a separate guiding surface. Moreover, the transmission of vibration and noise to the casing surrounding the impact member is advantageously prevented by using attenuating elements, which arrangement leads to a simple and effective attenuation of vibration and noise.

In the impact hammer of the invention, the employed attenuation elements can be made of solid, gaseous or liquid materials. In a simple form, the attenuating elements are advantageously made of some elastic material, such as rubber, plastic, polyurethane or other similar material. In that case, the attenuating elements advantageously are bonded to the members of the impact hammer. The external surfaces of the attenuating elements then correspond in shape to surfaces of the members of the impact hammer and are typically straight or curved.

The attenuating elements of the invention can also be, for instance, spring-like, in which case they are advantageously made of metal. Further, the attenuating effect of the attenuating elements can advantageously be created, for example, by means of levitation caused by an air cushion or a magnet. In order to create the attenuating effect, hydraulic fluid can also be used. In the impact hammer of the invention, the attenuating elements of the member guiding the piston and of the member guiding the impact member can be either of a similar type, in which case the attenuating effect is obtained in a similar fashion, or of two different types, in which case different mechanisms are used for creating the attenuating effect. Advantageously the attenuating elements are, however, so installed, that the protective casing of the impact hammer and the housing elements of the impact hammer are not in sliding contact such as to lead to wear.

According to the invention, by essentially flexibly separating the piston-guiding member of a hydraulic impact hammer from the housing element that guides the impact member, the propagation of tension waves reflected from the impact member, and the propagation of the forces caused by bending the impact member, to the piston-guiding member and to the valve system guiding the hydraulic fluid, are advantageously prevented. Thus, the valve system controlling the hydraulic fluid, which system is needed for operating the piston, is subjected to lower external forces, so that the valve system can be made simpler and more reliable. Moreover, the control and bearings of the piston can be designed for a smaller load. This simplifies the structure, and the risk of seizure in the piston and the cylinder is reduced.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
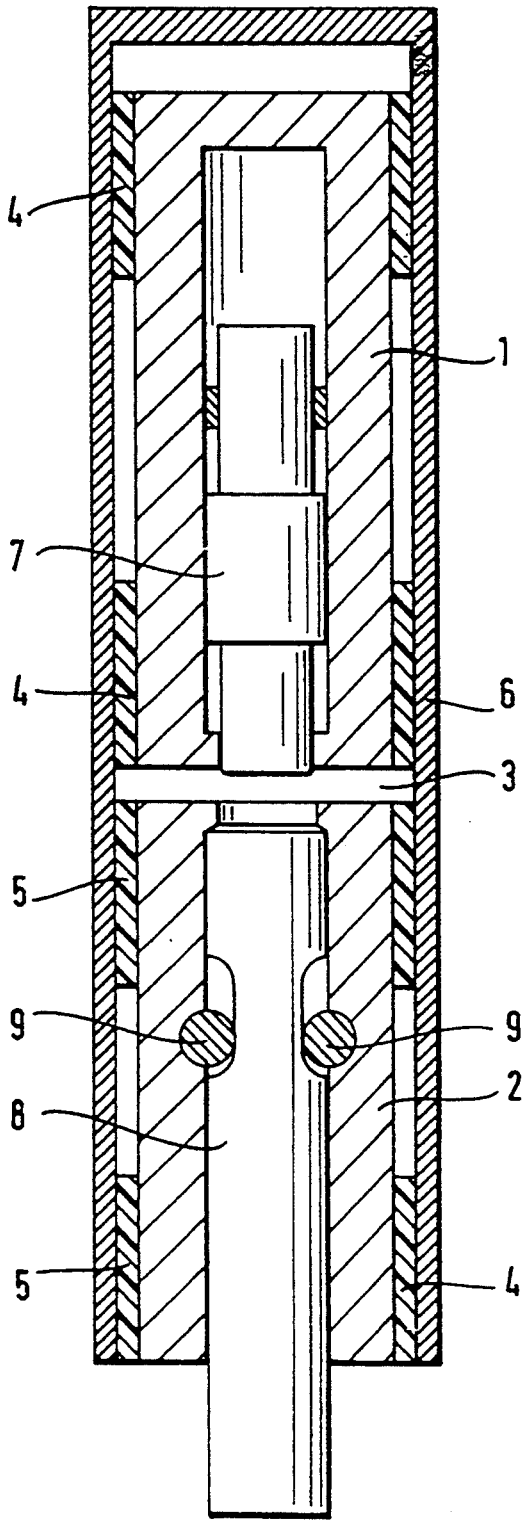
FIG. 1 illustrates a preferred embodiment of the invention in a side-view cross-section while the piston is in its top position.
Figure 2:
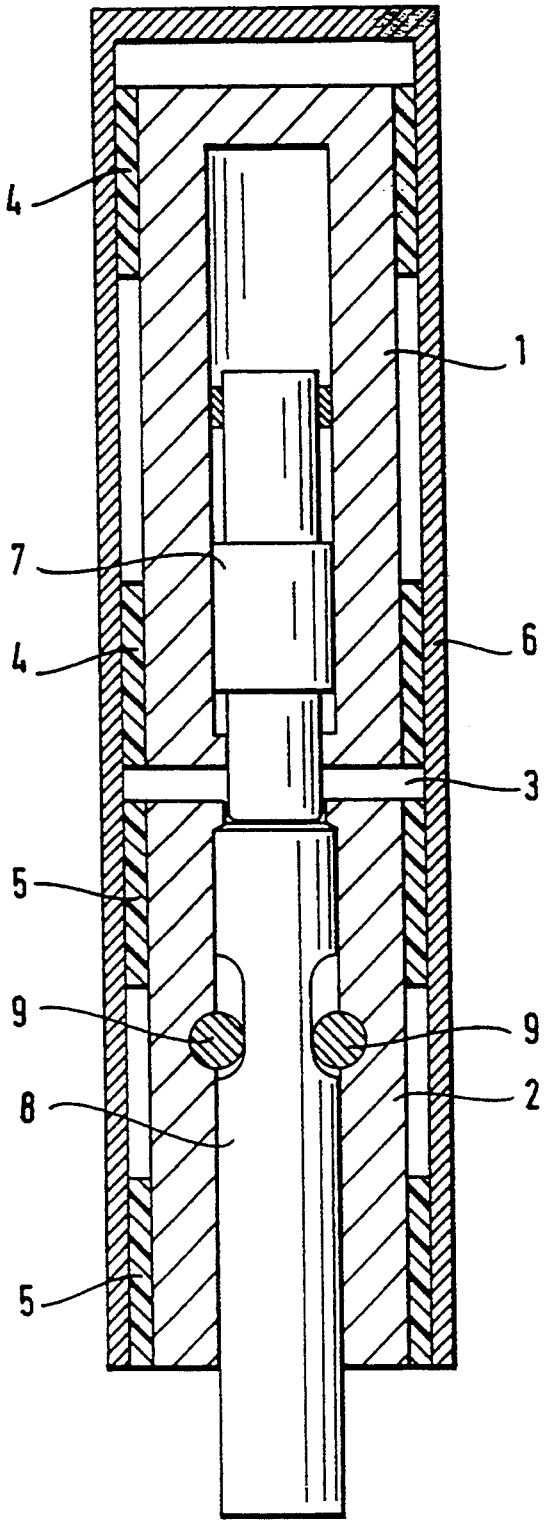
FIG. 2 illustrates the embodiment of FIG. 1 in a side-view cross-section, at the moment when the impact hammer is striking.

According to FIGS. 1 and 2, the member 1 guiding the piston and the member 2 guiding the impact member are separated from each other by the space 3. The guide member 1 is supported inside the protective casing 6 by means of elastic attenuating elements 4, and member 2 is supported inside the protective casing 6 by means of elastic attenuating elements 5. In this fashion, the members 1 and 2 are interconnected in a manner allowing relative axial and radial movement of the members 1 and 2, subject to forces created on deforming the attenuating elements. The attenuating elements 4 and 5 serve to align the guide member coaxially with the protective casing, so that they are aligned with each other. When hydraulic fluid is supplied to the chamber above the piston 7, the piston 7 is driven downwards and strikes the top end of the impact member 8. The centralizing achieved by means of the attenuating elements 4 and 5 ensures that the piston 7 is axially aligned with the impact member when it strikes the impact member. The downward motion of the impact member 8 is restricted by means of holding pins 9. The attenuating elements 4 and 5 are in the form of sleeves, and are adhesively bonded at their outer surfaces to the protective casing and at their inner surfaces to the guide members 1 and 2 respectively.

Figure 3:
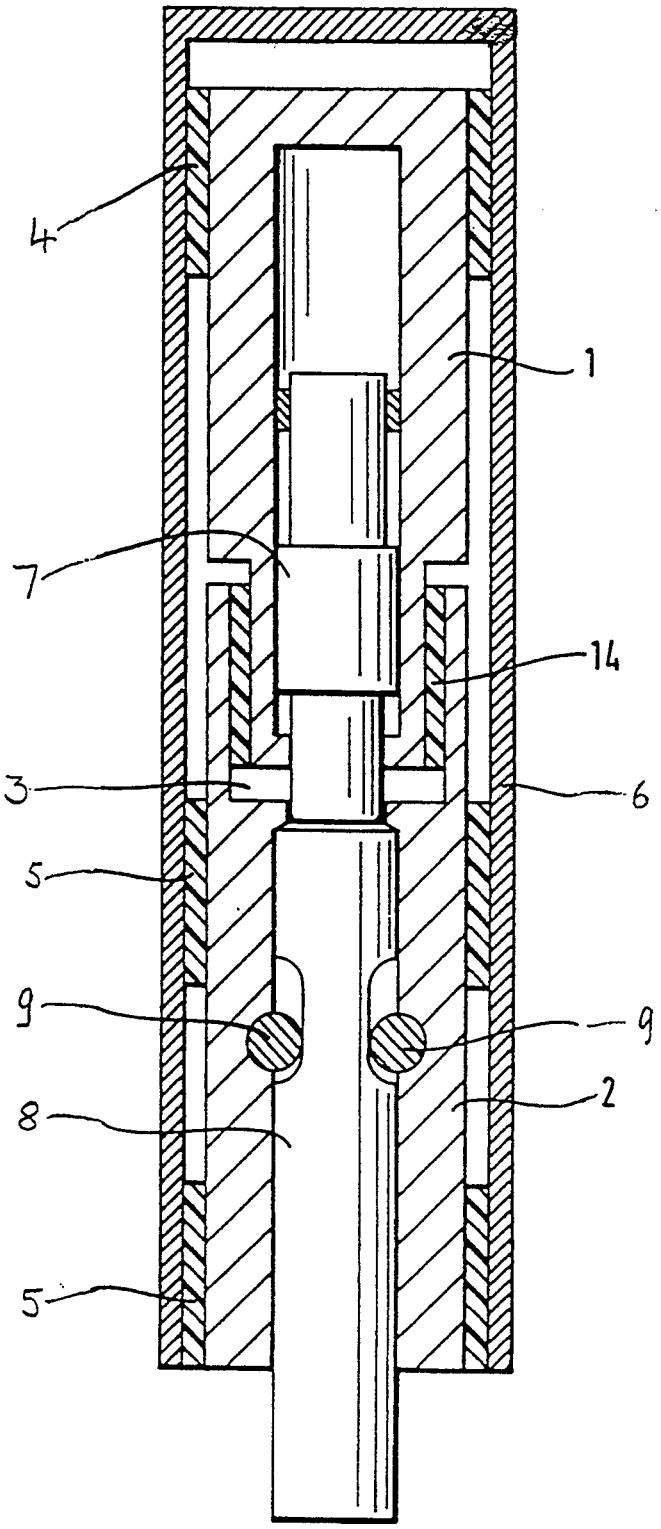
FIG. 3 illustrates another preferred embodiment of the invention in a side-view cross-section, when the housing elements are guided with a radial attenuator.

In FIG. 3, the piston guiding member 1 and the member 2 guiding the impact member 8 are formed with extensions that fit one within the other, and an attenuating element 14, in the form of an elastic sleeve, is installed between the inner and outer extensions. The elastic attenuating element 14 serves to guide the members 1 and 2 radially also during charge, i.e. during the impact. It will be noted that only one sleeve 4 is provided between the guide member 1 and the protective casing 6, the member 1 being guided sufficiently at its lower end by the attenuating element 14 and the upper attenuating element 5. The parts illustrated in FIG. 3 are operated in similar fashion as the respective parts of FIGS. 1 and 2. The attenuating element 14 is adhesively bonded at its interior surface to the inner extension of the member 1 and at its exterior surface to the outer extension of the member 2. In FIG. 3 as well as in FIGS. 1 and 2, the elastic attenuating elements allow limited longitudinal and radial movement of the members 1 and 2 relative to the protective casing 6.

It will be appreciated that the invention is not restricted to the particular embodiments that have been described, and that variations may be made therein without departing from the scope of the invention as defined in the appended claims and equivalents thereof.

We claim:

1. A hydraulic impact hammer comprising an outer protective casing, a first guide member defining a first cylindrical bore, a first attenuating element supporting the first guide member inside the casing in a manner allowing the first guide member to move radially and axially relative to the casing, a piston fitted slidably in the first cylindrical bore, a second guide member defining a second cylindrical bore, a second attenuating element supporting the second guide member inside the casing in non-contacting relationship with the first guide member, in a manner allowing the second guide member to move radially and axially relative to the casing independently of the first guide member, and at a location such that the second bore is substantially coaxial with the first bore, and an impact member fitted slidably in the second cylindrical bore, wherein at least one of the first and second attenuating elements is connected to the protective casing and one of the first and second guide members includes a sleeve that surrounds a cylindrical part of the other of the first and second guide members, whereby the first and second guide members have surfaces in radially spaced confronting relationship and the hammer further comprises a third attenuating element between the confronting surfaces of the first and second guide members.

2. A hammer according to claim 1, wherein at least one of the attenuating elements is connected to the protective casing.

3. A hammer according to claim 1, wherein at least one of the attenuating elements is made of elastic material.

4. A hammer according to claim 3, wherein the elastic material is rubber.

5. A hammer according to claim 3, wherein the elastic material is polyurethane.

6. A hammer according to claim 1, wherein the first attenuating element is made of elastic material and is in the form of a sleeve that is adhesively bonded at an interior surface to the first guide member and is adhesively bonded at an exterior surface to the protective casing.

7. A hammer according to claim 1, wherein the second attenuating element is made of elastic material and is in the form of a sleeve that is adhesively bonded at an interior surface to the second guide member and is adhesively bonded at an exterior surface to the protective casing.

8. A hammer according to claim 1, wherein the third attenuating element is made of elastic material and is in the form of a sleeve that is adhesively bonded at an exterior surface to said one guide member and is adhesively bonded at an interior surface to said other guide member.

* * * * *